US012714161B1

(12) United States Patent
Banks

(10) Patent No.: US 12,714,161 B1
(45) Date of Patent: Aug. 25, 2026

(54) TROUSER ASSEMBLIES AND METHODS OF TUCKING LOWER PORTIONS OF SHIRTS IN TROUSER ASSEMBLIES

(71) Applicant: Isabel Banks, Houston, TX (US)

(72) Inventor: Isabel Banks, Houston, TX (US)

( * ) Notice: Subject to any disclaimer, the term of this patent is extended or adjusted under 35 U.S.C. 154(b) by 0 days.

(21) Appl. No.: 19/036,080

(22) Filed: Jan. 24, 2025

(51) Int. Cl.
*A41D 1/06* (2006.01)

(52) U.S. Cl.
CPC ..... *A41D 1/06* (2013.01)

(58) Field of Classification Search
CPC ... A41F 17/00; A41F 5/00; A41F 9/02; A41D 1/06; A41D 1/21; A41D 2400/38
See application file for complete search history.

(56) References Cited

U.S. PATENT DOCUMENTS 1,859,900 A * 5/1932 Minifred ..... A41B 9/04 2/407
2013/0048687 A1* 2/2013 Do ..... A41F 9/00 224/191
2015/0230531 A1* 8/2015 Merchen ..... A41F 17/00 2/400
2019/0014844 A1* 1/2019 Osman ..... A41F 17/00
2019/0282885 A1* 9/2019 Popenhagen ..... A63B 23/0222

FOREIGN PATENT DOCUMENTS

KR 101938859 B1 * 1/2019 ..... A41B 9/14

OTHER PUBLICATIONS

Translation of KR-101938859-B1 (Year: 2019).*

* cited by examiner

*Primary Examiner* — Grady Alexander Nunnery
(74) *Attorney, Agent, or Firm* — Douglas H. Elliott; Nathan Q. Huynh; Elliott Law PLLC

(57) ABSTRACT

Disclosed herein are methods of tucking a lower portion of a shirt, which methods may include: providing a trouser assembly that may include: a waistband having an upper waistband portion and a lower waistband portion; a yoke having an upper yoke portion coupled to the lower waistband portion and a lower yoke portion, a seat having an upper seat portion coupled to the lower yoke portion; and a support band having an upper support portion and a lower support portion, wherein the lower support portion may be coupled to the lower yoke portion; wrapping the support band around a human waist; disposing a portion of the lower portion of the shirt between the support band and the yoke; abutting a portion of the lower portion of the shirt against the support band; and abutting a portion of the lower portion of the shirt against the yoke.

16 Claims, 9 Drawing Sheets

TROUSER ASSEMBLIES AND METHODS OF TUCKING LOWER PORTIONS OF SHIRTS IN TROUSER ASSEMBLIES

BACKGROUND

1. Field of Inventions

The field of this application and any resulting patent is trouser assemblies with support bands and methods for supporting trousers.

2. Description of Related Art

Various trouser assemblies with waistbands have been proposed including some of the prior art references listed on the cover of the patent. However, those trouser assemblies lack the combination of features of the trouser assemblies disclosed herein. Furthermore, it is contemplated that the trouser assemblies disclosed herein may solve certain problems that prior art trouser assemblies have failed to solve. Also, it is contemplated that the trouser assemblies disclosed herein have benefits that would be surprising and unexpected to a hypothetical person of ordinary skill with knowledge of the prior art existing as of the filing date of this application. A need therefore exists for improved trouser assemblies.

SUMMARY

Disclosed herein are methods of tucking a lower portion of a shirt, which methods may include: providing a trouser assembly that may include: a waistband having an upper waistband portion and a lower waistband portion; a yoke having an upper yoke portion coupled to the lower waistband portion and a lower yoke portion, a seat having an upper seat portion coupled to the lower yoke portion; and a support band having an upper support portion and a lower support portion, wherein the lower support portion may be coupled to the lower yoke portion; wrapping the support band around a human waist; disposing a portion of the lower portion of the shirt between the support band and the yoke; abutting a portion of the lower portion of the shirt against the support band; and abutting a portion of the lower portion of the shirt against the yoke.

Additionally, disclosed herein are methods of tucking a lower portion of a shirt, which methods may include: providing a trouser assembly that may include: providing a trouser assembly that may include: a waistband having an upper waistband portion, a lower waistband portion, an outer waistband surface, and an inner waistband surface; a yoke having an upper yoke portion, a lower yoke portion, an outer yoke surface, and an inner yoke surface, wherein the upper yoke portion is coupled to the lower waistband portion; a seat having an upper seat portion coupled to the lower yoke portion; and a support band having an upper support portion, a lower support portion, an outer support surface, and an inner support surface, wherein the lower support portion may be coupled to the lower yoke portion; wrapping the support band around a human waist; disposing a portion of the lower portion of the shirt between the outer support surface and the inner yoke surface; abutting an inner surface of the lower portion of the shirt against the outer support surface; and abutting an outer surface of the lower portion of the shirt against the inner yoke surface.

Also, disclosed herein are trouser assemblies for tucking a lower portion of a shirt, which trouser assemblies may include: a waistband having an upper waistband portion and a lower waistband portion; a yoke having an upper yoke portion coupled to the lower waistband portion and a lower yoke portion; a seat having an upper seat portion coupled to the lower yoke portion; a support band having a lower support portion coupled to the seat; wherein a portion of the support band and a portion of the waist band may be capable of having tucked there between the lower rear portion of the shirt.

In addition, disclosed herein are trouser assemblies for tucking a lower portion of a shirt, which trouser assemblies may include: a waistband having an upper waistband portion, a lower waistband portion, an outer waistband surface, and an inner waistband surface; a yoke having an upper yoke portion coupled to the lower waistband portion, a lower yoke portion, an outer yoke surface, and an inner yoke surface, a seat having an upper seat portion coupled to the lower yoke portion; a support band having a lower portion coupled to the upper seat portion, a lower support portion, an inner support surface, and an outer support surface; wherein the outer support surface and the inner yoke surface may be capable of having tucked there between the lower rear portion of the shirt.

DETAILED DESCRIPTION

1. Introduction

Figure 1:
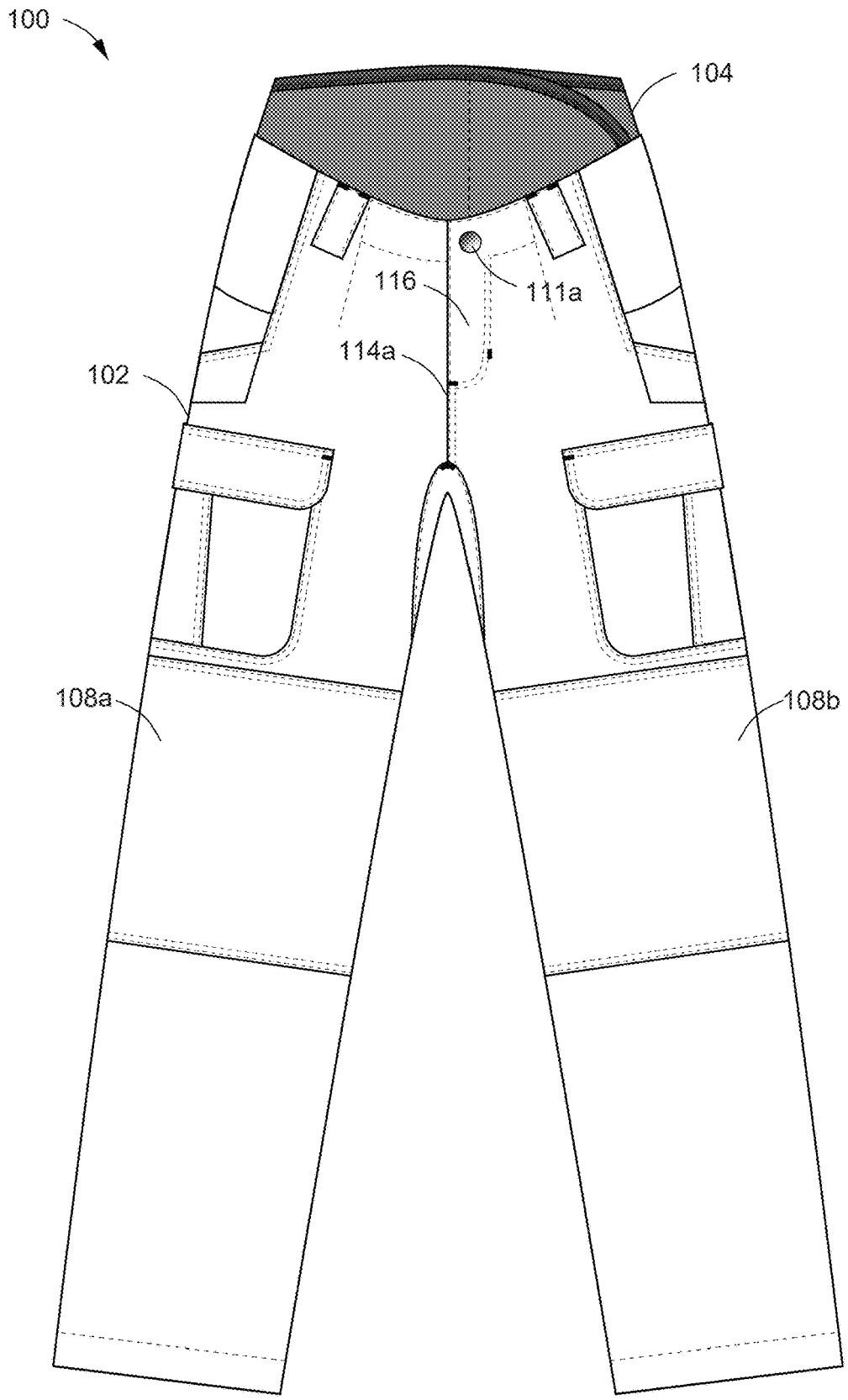
FIG. 1 illustrates a frontal view of a trouser assembly including a trouser in a clasped configuration with a fully closed fly and wrapped support band disposed therein.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist with the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "adjacent" as used herein means next to and may include physical contact but does not require physical contact.

The term "abut against" as used herein as a verb is defined as position adjacent to and either physically touch or press against, directly or indirectly. After any abutting takes place with one object relative to another object, the objects may be fully or partially "abutted." A first object may be abutted against a second object such that the second object is limited from moving in a direction of the first object. For example, a surface of a flap may be abutted against a surface of a trouser.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object or surface including a structure such as trouser and/or underpants. For example, an aperture may be a three-dimensional opening that begins on one side of a solid object and ends on the other side of the object, e.g., the space inside a trouser, or an aperture passing through a trouser wall. An aperture may alternatively be an opening that does not pass entirely through an object, but only partially passes through, e.g., a groove. An aperture can be an opening in an object that is completely circumscribed, defined, or delimited by the object itself. Alternatively, an aperture can be an opening formed when one object is combined with one or more other objects or structures. An aperture may receive an object, e.g., coupling means such as button(s), zipper tape, pin(s), thread(s), tape, latch(es), hook (s), fastener(s), lock(s), male and/or female connector(s) (e.g., snap buttons and stud and socket buttons), clip(s), clamp(s), clasp(s), and/or knot(s).

The term "assembly" as used herein is defined as any set of components or structures that have been fully or partially assembled together. A group of structures or assemblies may be coupled to form a larger assembly. For example, a trouser assembly may include not only a trouser, but also a support band.

The term "band" as used herein is defined as a flexible structure that has a long side and at least one short side and forms a loop, or is capable of forming a loop, around a human body part. One example of a band is a waistband, which is a band that has an inner surface configured to abut against the wearer's waist, is preferably integral with the trouser, or otherwise coupled with, or part of, the trouser and may thus have a circumferential arrangement when the trouser of which it is a part is worn by the wearer. A band may be rectangular in cross-section, as illustrated in some of the drawings. A band may be continuous, or it may have two ends, and belt loops in the trousers may be disposed in the trousers and directed transversely to the lengthwise direction of the band. A band preferably comprises the same material as the rest of the trouser and, accordingly, may comprise cloth and be constructed from any one of various textiles, e.g., fabric, cotton, linen, plastic, polyester, Kevlar, and/or leather. A band may be folded into two or more adjacent portions or segments. Certain bands disclosed herein may have segments folded into plies that are sutured together. A band may have a flap extending therefrom. The term "waistband" as used herein is defined as a band for forming a loop around and/or resting on a human waist. Preferably, a waistband is part of a trouser, as shown in the drawings. The term "support band" as used herein is defined as a band for forming a loop around a human torso. A support band may loop around a human back, waist, and belly. A support band may have portions rested on a human belly and lower back. Preferably, a support band is a unitary structure that is coupled to a trouser, as shown in the drawings.

The term "coupled" as used herein is defined as directly or indirectly connected or attached. A first object may be coupled to a second object such that the first object is positioned at a specific location and orientation with respect to the second object. For example, underpants may be coupled to a trouser, and a zipper assembly may be coupled to a trouser. A first object may be either permanently or removably coupled to a second object. Two objects are "permanently coupled," if once they are coupled, the two objects, in some cases, cannot be separated. Two objects may be "removably coupled" to each other, e.g., via zipper tapes, coupling means, stitching, threads, pins, clasps, tape, latches, hooks, hooks and loops, Velcro®, fasteners, locks, male and female connectors, clips, clamps, knots, and/or surface-to-surface contact. For example, a an first end and a second end of support band may be removably coupled to each other such that the first end may then be uncoupled and removed from the second end.

The term "coupling means" as used herein is defined as any structure or combination of structures disclosed herein, including any disclosed assembly, that is capable of performing the function of coupling structures or objects together, either by itself or in combination with another structure, including cloth structures made from natural materials such as cotton, linen, etc., and also artificial materials such as polypropylene. A coupling means may be or include a button, magnet, zipper tape, pin, thread, tape, latch, hooks and loops, fastener, lock, male and female connectors (e.g., stud and socket connectors), clip, clamp, clasp, knot and/or stitching. A coupling means may be a button sewn onto a first structure, which button may be extended through an aperture of a second apparel structure. Examples of cloth structures include structures made of natural textiles such as fabric, cotton, and linen, and also include those made from artificial materials such as polypropylene, plastics, polyester, Kevlar, and leather. A coupling means may be, for example, a first snap button and second snap button sewn onto the surfaces of particular apparel structures in which the first snap button may have a stud, and the second snap button may have a socket for receiving the stud. The stud may be abutted against a surface of the second snap button. Another coupling means may be a hook and a pin sewn onto respective apparel structures, in which the hook may be coupled to the pin. A coupling means may be a first magnet and second magnet sewn onto respective apparel structures, in which the first magnet and the second magnet may be disposed adjacent to one another and may be attracted to each other. Magnets may be sewn onto inner surfaces or outer surfaces of apparel structures. Magnets may be embedded in apparel structures. An additional coupling means may be hooks and loops sewn onto respective apparel structures, in which the hook may be coupled to the loops. An additional coupling means may be stitching, e.g., of thread, sewn through two or more apparel structures.

The terms "first", "second," "front," and "rear" as used herein merely differentiate two or more things or actions, and do not signify anything else, including order of importance, sequence, etc.

The term "flap" as used herein is defined as a flexible structure that has at least one long side and at least one short side, as exemplified in some of the drawings. In certain embodiments, one type of flap can be part of the trousers, in which a flap is preferably part of the waistband, e.g., a part that extends past the opening in the front of the trouser and overlaps another part of the waistband and may include a male portion of a clasp. Another type of flap can be part of the underpants and can extend from a waistband of underpants. A flap may comprise cloth and can be constructed from any one of various textiles or other fabrics or apparel materials, e.g., cotton, linen, plastic, polyester, Kevlar, and/or leather. A flap may be folded into two or more adjacent portions or segments. A flap may have a portion coupled to a front and/or a rear of a trouser. A flap may have a portion coupled to a front and/or a rear of a waistband of underpants.

The term "fly" as used herein is defined as a structure of a trouser that has two fly portions that can be uncoupled to create a larger opening in a trouser. When two fly portions of a fly are coupled the opening in a trouser is smaller than when the two fly portions are uncoupled. Each fly portion may include a zipper tape. A first zipper tape coupled to a first fly portion may include teeth, a slider, and a box. A second zipper tape coupled to a second fly portion may include teeth and a pin. A first zipper tape and a second zipper tape configured for removable coupling may be parts of a zipper assembly. When used herein as a noun, the term "zipper" means two zipper tapes with teeth that are capable of meshing together. When used as a noun, the term "zipper" means to move the zipper so that the teeth of the zipper tapes are either meshing or un-meshing. The term "zippered" means the teeth of the zipper tapes are fully meshed, and the zipper is considered closed.

The term "providing" as used herein is defined as making available, furnishing, supplying, equipping, or causing to be placed in position.

The term "seat" as used herein is defined as a structure that is part of a trouser located at the rear of the trouser, preferably at an upper portion above a leg portion of a trouser legs. Preferably, a seat is the part of a trouser that is adjacent to and is capable of covering part or all of a trouser wearer's buttocks. A seat may have rear pockets coupled thereto. A seat may be made of natural textiles such as fabric, cotton, and linen, and may also include those made from artificial materials such as polypropylene, plastics, polyester, Kevlar, and leather. A seat may provide a transition from a leg portion of a trouser leg. A seat may be unitary. A seat may be constructed from multiple smaller structures.

The term "surface" as used herein is defined as any face and/or boundary of a structure. A surface may also refer to that flat or substantially flat area that is extended across a flat structure which may, for example, be part of a trouser and underpants. A surface may also refer to any curved area that extends circumferentially around a cylindrical structure or object which may, for example, be part of a trouser leg. A surface may have irregular contours. A surface may be formed from coupled components, e.g., trouser legs, zipper tapes, underpants, buttons, and/or magnets. Coupled components may form irregular surfaces. A plurality of surfaces may be connected to form a polygonal cross-section. An example of a polygonal cross-section may be triangular, square, rectangular, pentagonal, hexagonal, or octagonal. Socket surfaces may have socket surfaces connected to form a polygonal shape, e.g., triangular, square, rectangular, pentagonal, hexagonal, or octagonal.

The term "trouser" as used herein is defined as any garment capable of covering a lower portion of a human body from the waist towards all or part of the legs, having two cylindrical parts, one for each leg. A trouser may comprise, e.g., be constructed from, any one of various types of cloth or other apparel material described herein, including natural textiles, e.g., fabric, cotton, or linen, or artificial materials such as plastic, polyester, Kevlar, and/or leather. A trouser may include a waistband, a yoke, and two trouser legs. Each trouser leg may have a leg portion that covers a wearer's legs, a front portion that covers the wearer's pubic area, and a seat that covers the wearer's buttocks. Although the term "trouser" (singular) is used herein, a synonymous term often used elsewhere is "trousers" (plural) and as used herein they have the same meaning.

The term "unitary" as used herein is defined as having the form of a single unit.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" or "top" identifies any object or part of a particular object that is farther away from the center of the earth than some other object or part of that particular object, when the objects are positioned in their intended useful positions. The term "lower" or "bottom" identifies any object or part of a particular object that is closer to the center of the earth than some other object or part of that particular object, when the objects are positioned in their intended useful positions.

The term "wrapping" as used herein is defined as forming a circle or enclosure around a structure, e.g., human belly, waist, and back. After any wrapping takes place, the structure may be fully or partially "wrapped." Wrapping preferably involves arranging a first structure around another a second structure such that the first structure and encircles the second structure. For example, a support band may be wrapped around a human waist, such that the support band encircles the waist. The term "yoke" as used herein is defined as a structure that is part of trousers and is positioned between trouser waistband and the seat(s) of trousers. A yoke is preferably capable of coupling, and preferably directly connecting, a trouser waistband to both sides of the seat(s) of the trousers. A yoke may be made of any material, e.g., natural textiles such as fabric, cotton, and linen, and also include those made from artificial materials such as polypropylene, plastics, polyester, Kevlar, and leather. The yoke preferably is above the trouser seat and does not extend around to the front of the trousers, e.g., to the trouser fly. In one or more embodiments, a yoke has an inner surface facing the wearer's torso that is made of a different material than the trouser seat, and preferably has a texture similar to sandpaper, so that fabric, e.g., the fabric of a shirt-tail, does not easily slide when forces are applied during the wearer's movement. A yoke may provide a transition from a wider hip to a narrower waist on a trouser wearer, which helps the trouser fit the wearer properly. A yoke may be unitary. A yoke may be constructed from multiple smaller structures.

3. Certain Specific Embodiments

Disclosed herein are methods of tucking a lower portion of a shirt, which methods may include: providing a trouser assembly that may include: a waistband having an upper waistband portion and a lower waistband portion; a yoke having an upper yoke portion coupled to the lower waistband portion and a lower yoke portion, a seat having an upper seat portion coupled to the lower yoke portion; and a support band having an upper support portion and a lower support portion, wherein the lower support portion may be coupled to the lower yoke portion; wrapping the support band around a human waist; disposing a portion of the lower portion of the shirt between the support band and the yoke; abutting a portion of the lower portion of the shirt against the support band; and abutting a portion of the lower portion of the shirt against the yoke.

Additionally, disclosed herein are methods of tucking a lower portion of a shirt, which methods may include: providing a trouser assembly that may include: providing a trouser assembly that may include: a waistband having an upper waistband portion, a lower waistband portion, an outer waistband surface, and an inner waistband surface; a yoke having an upper yoke portion, a lower yoke portion, an outer yoke surface, and an inner yoke surface, wherein the upper yoke portion is coupled to the lower waistband portion; a seat having an upper seat portion coupled to the lower yoke portion; and a support band having an upper support portion, a lower support portion, an outer support surface, and an inner support surface, wherein the lower support portion may be coupled to the lower yoke portion; wrapping the support band around a human waist; disposing a portion of the lower portion of the shirt between the outer support surface and the inner yoke surface; abutting an inner surface of the lower portion of the shirt against the outer support surface; and abutting an outer surface of the lower portion of the shirt against the inner yoke surface.

Also, disclosed herein are trouser assemblies for tucking a lower portion of a shirt, which trouser assemblies may include: a waistband having an upper waistband portion and a lower waistband portion; a yoke having an upper yoke portion coupled to the lower waistband portion and a lower yoke portion; a seat having an upper seat portion coupled to the lower yoke portion; a support band having a lower support portion coupled to the seat; wherein a portion of the support band and a portion of the waist band may be capable of having tucked there between the lower rear portion of the shirt.

In addition, disclosed herein are trouser assemblies for tucking a lower portion of a shirt, which trouser assemblies may include: a waistband having an upper waistband portion, a lower waistband portion, an outer waistband surface, and an inner waistband surface; a yoke having an upper yoke portion coupled to the lower waistband portion, a lower yoke portion, an outer yoke surface, and an inner yoke surface, a seat having an upper seat portion coupled to the lower yoke portion; a support band having a lower portion coupled to the upper seat portion, a lower support portion, an inner support surface, and an outer support surface; wherein the outer support surface and the inner yoke surface may be capable of having tucked there between the lower rear portion of the shirt.

Any one of the methods disclosed herein may further include coupling a first end of the support band to a second end of the support band.

Any one of the methods disclosed herein may further include disposing a first end of the support band and a second end of the support band on a human belly.

Any one of the methods disclosed herein may further include pressing a portion of the support band against a human lower back.

Any one of the methods disclosed herein may further include pressing a portion of the support band against a portion of the lower shirt portion.

In any one of the methods or structures disclosed herein, the lower portion of the shirt may be inhibited from slipping from between the support band and the yoke.

Any one of the methods disclosed herein may further include disposing a portion of the lower portion of the shirt between the support band and the waistband.

In any one of the methods or structures disclosed herein, the lower portion of the shirt may be inhibited from slipping from between the support band and the waistband.

In any one of the methods or structures disclosed herein, the upper support portion may be above the waistband.

In any one of the methods or structures disclosed herein, the lower support portion may be below the waistband.

In any one of the methods or structures disclosed herein, the lower support portion may be adjacent to the yoke.

In any one of the methods or structures disclosed herein, the lower yoke portion may be below the waistband.

In any one of the methods or structures disclosed herein, the upper yoke portion may be above the seat.

Any one of the methods disclosed herein may further include pressing, with the waistband, a portion of the lower portion of the shirt against the support band.

Any one of the methods disclosed herein may further include disposing a portion of the lower portion of the shirt between the outer support surface and inner waistband surface.

In any one of the methods or structures disclosed herein, the lower portion of the shirt is inhibited from slipping from between the outer support surface and the inner yoke surface.

In any one of the methods or structures disclosed herein, the lower portion of the shirt may be inhibited from slipping from between the outer support surface and the inner waistband surface.

In any one of the methods or structures disclosed herein, the upper support portion may be above the waistband.

In any one of the methods or structures disclosed herein, the lower support portion may be below the waistband.

In any one of the methods or structures disclosed herein, the outer support surface may be adjacent to the inner yoke surface.

In any one of the methods or structures disclosed herein, the outer support surface may be adjacent to the inner waistband surface.

Any one of the methods disclosed herein may further include pressing, with the waistband, a portion of the lower portion of the shirt against the outer support surface.

Any one of the methods disclosed herein may further include disposing a portion of the lower portion of the shirt between the outer support surface and the inner waistband surface.

In any one of the methods or structures disclosed herein, the waistband may have a height of at least 0.5 inch.

In any one of the methods or structures disclosed herein, the waistband may have a height of at least 1 inch.

In any one of the methods or structures disclosed herein, the waistband may have a height of at least 1.5 inch.

In any one of the methods or structures disclosed herein, a portion of the support band and a portion of the yoke may be capable of having tucked there between the lower rear portion of the shirt.

In any one of the methods or structures disclosed herein, the yoke may have a height of at least 0.5 inch.

In any one of the methods or structures disclosed herein, the yoke may have a height of at least 1 inch.

In any one of the methods or structures disclosed herein, the yoke may have a height of at least 1.5 inch.

In any one of the methods or structures disclosed herein, the yoke may have a height of at least 2 inches.

In any one of the methods or structures disclosed herein, the yoke may have a height of 2.5 inches.

In any one of the methods or structures disclosed herein, the yoke may be below the waistband.

In any one of the methods or structures disclosed herein, the yoke may be between the waistband and the seat.

In any one of the methods or structures disclosed herein, the lower yoke portion may be 3 inches from the upper waistband portion.

In any one of the methods or structures disclosed herein, the seat may be below the yoke.

In any one of the methods or structures disclosed herein, a portion of the lower yoke portion may be coupled to a portion of the upper seat portion and a portion of a back riser of the trouser assembly.

In any one of the methods or structures disclosed herein, the support band and the waistband may be concentric.

In any one of the methods or structures disclosed herein, the support band and the waistband may form an annulus.

In any one of the methods or structures disclosed herein, the outer support surface may be adjacent to the inner waistband surface.

In any one of the methods or structures disclosed herein, the outer support surface may be adjacent to the inner yoke surface.

4. Specific Embodiments in the Drawings

The drawings presented herein are for illustrative purposes only and do not limit the scope of the disclosure. Rather, the drawings are intended to help enable one having ordinary skill in the art to make and use the assemblies disclosed herein.

This section addresses specific versions of trouser assemblies with zippers shown in the drawings, which relate to assemblies, elements and parts that can be part of a trouser assembly with zippers. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Figure 2:
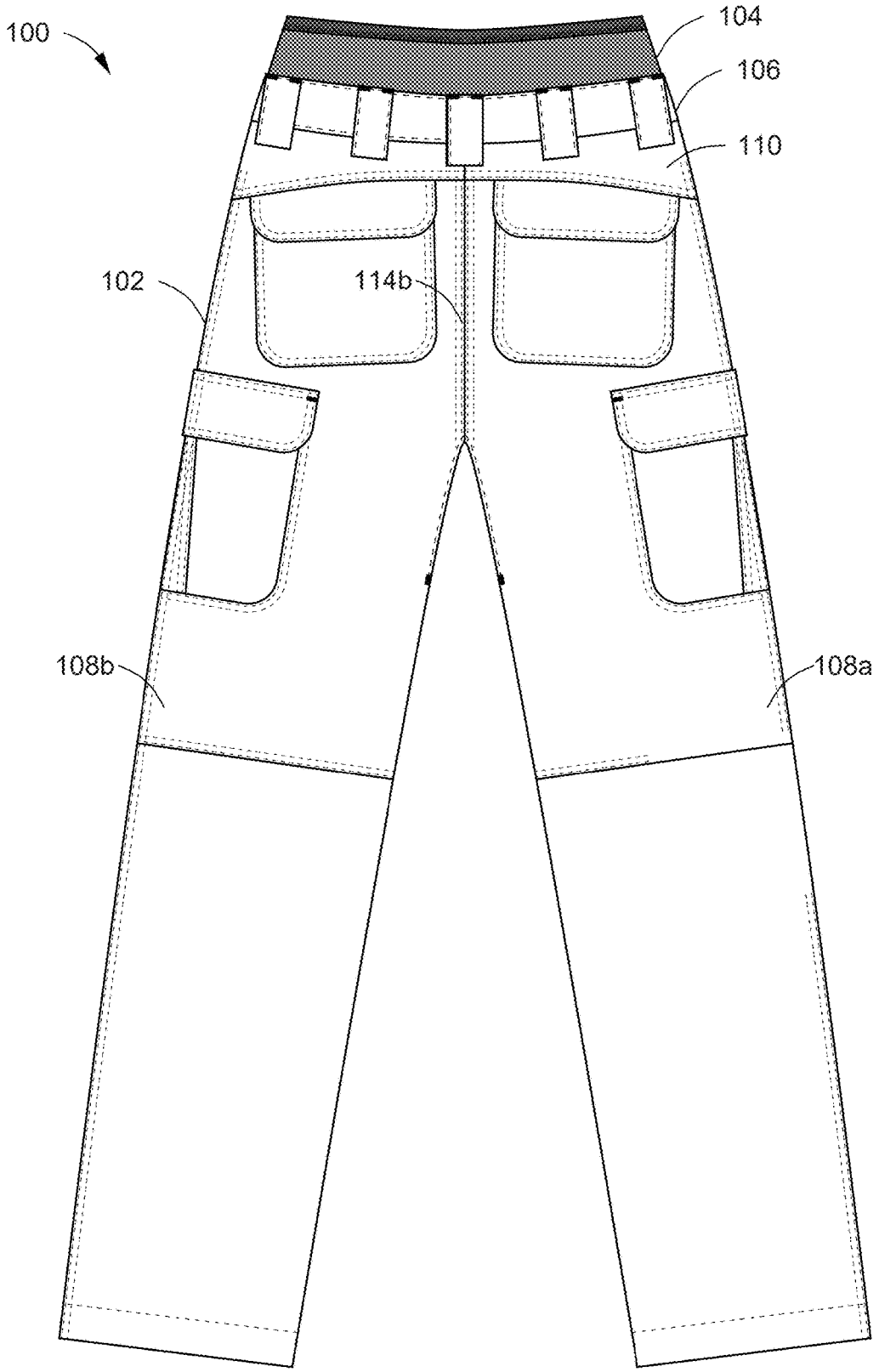
FIG. 2 illustrates a rear view of a trouser assembly including a trouser and a wrapped support band disposed therein.

FIG. 1 illustrates a frontal view of a trouser assembly 100 including a trouser 102 in a clasped configuration with a fully closed fly and a wrapped support band 104 disposed therein. FIG. 2 illustrates a rear view of a trouser assembly 100 including a trouser 102 and a wrapped support band 104 disposed therein. In this application and any resulting patent, a "trouser assembly" is an assembly of different parts and structures including a trouser and may also include a support band.

Referring to FIG. 1 and FIG. 2, the trouser 102 includes a waistband 106, a right trouser leg 108*a*, a left trouser leg 108*b*, and a yoke 110, each of which have inside surface(s) and outside surface(s). The trouser waistband 106 has an upper waistband portion, a lower waistband portion, a first waistband end, and second waistband end. A first snap button 111*a* is coupled to the first waistband end. A second snap button (not shown) is coupled to the second waistband end. The second snap button is capable of being removably coupled to the first snap button 111*a*.

Figure 3:
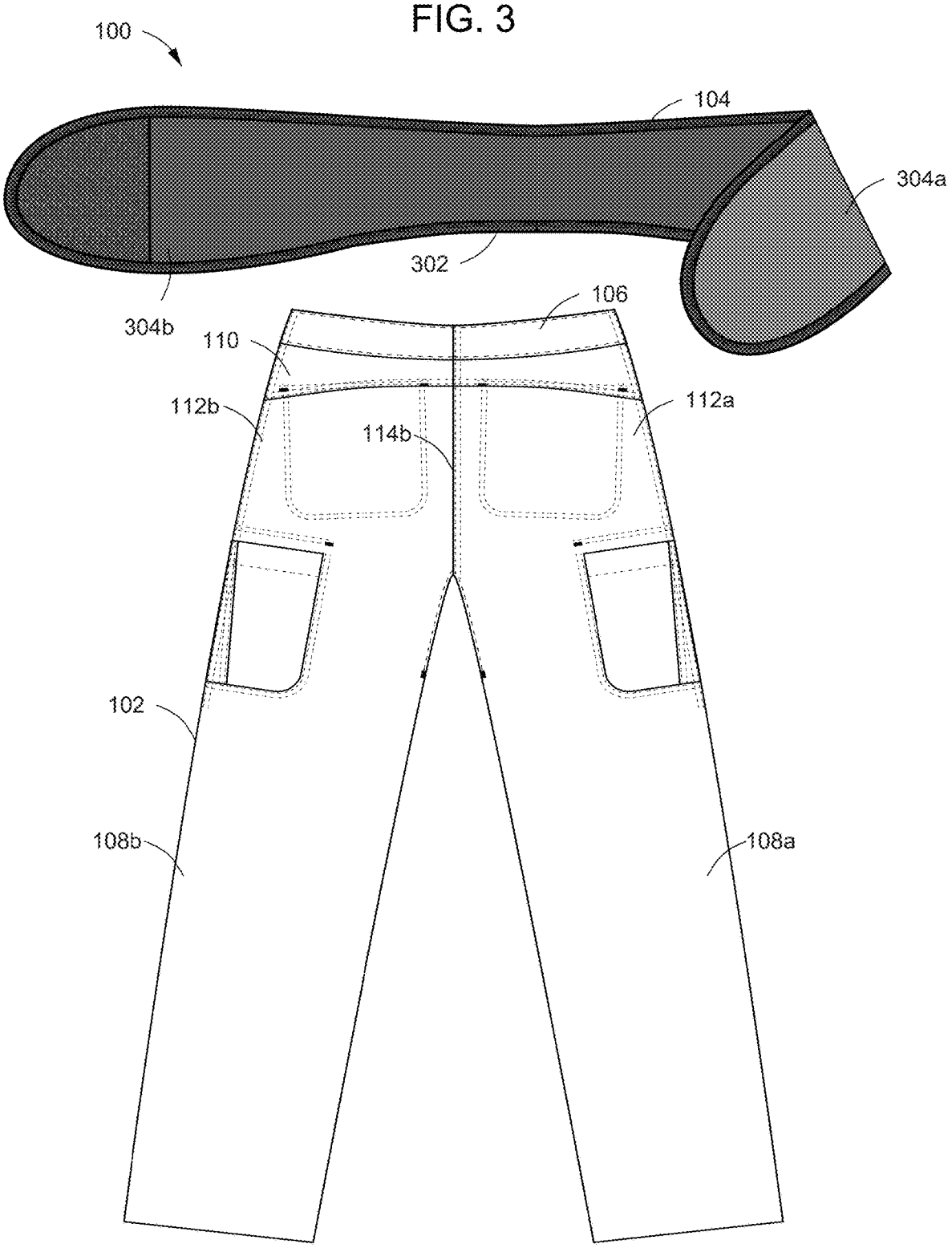
FIG. 3 illustrates an exploded frontal view of a trouser assembly showing a perspective view of a support band and a cutaway view of a trouser that shows the inside of a rear portion of the trouser.
Figure 4:
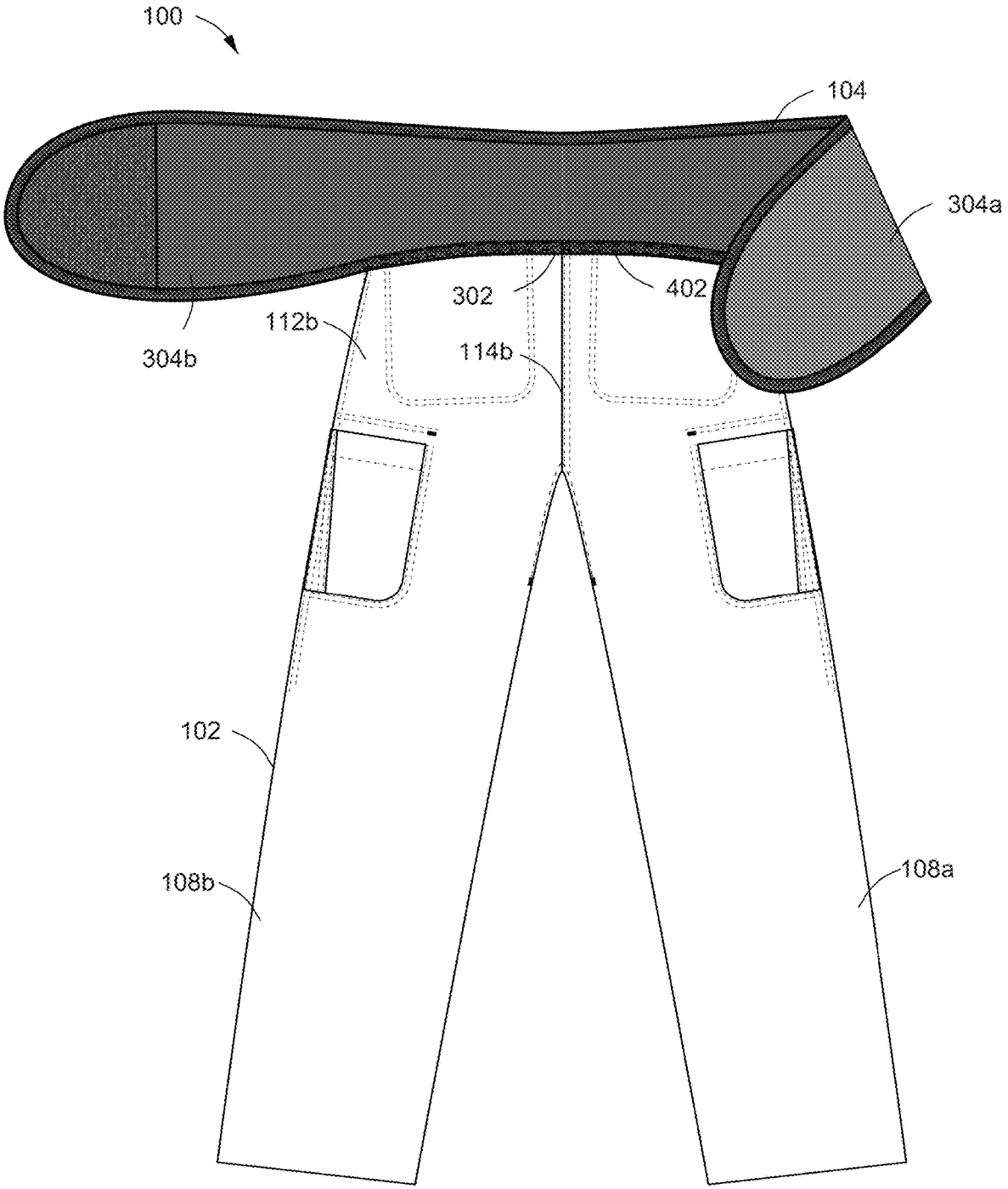
FIG. 4 illustrates an exploded frontal view of a trouser assembly showing a perspective view of a support band and a cutaway view of a trouser that shows the inside of a rear portion of the trouser.

The right trouser leg 108*a* has a right front trouser leg portion, right rear trouser leg portion, and right seat (see FIG. 3 and FIG. 4). The left trouser leg 108*b* has a left front trouser leg portion, left rear trouser leg portion, and a left seat (see FIG. 3 and FIG. 4). The right front trouser leg portion and right rear trouser leg portion have longitudinal sides that are coupled, e.g., stitched, together at a right inseam and at a right outseam. The left front trouser leg portion and left rear trouser leg portion also have longitudinal sides that are coupled, e.g., stitched, together at a left inseam and at a left outseam.

Additionally, the right trouser leg 108*a* and the left trouser leg 108*b* are coupled, e.g., stitched, together to form a front rise seam 114*a* and a rear rise seam 114*b*. The front rise seam 114*a* extends from the crotch of the trouser 102 to a fly 116 of the trouser 102. The rear rise seam 114*b* extends from the crotch of the trouser 102 to the yoke 110 (see FIG. 3 and FIG. 4).

The right front trouser leg portion and the left front trouser leg portion have upper portions that are coupled, e.g., stitched, to the waistband 106. The right seat and the left seat have upper portions that are coupled, e.g., stitched, to the yoke 110. The yoke 110 has an upper yoke portion and a lower yoke portion. The upper yoke portion is coupled to the lower waistband portion. The lower yoke portion is coupled to respective seats of the right trouser leg 108*a* and the left trouser leg 108*b*. Preferably, stitching that couples the right seat and the left seat to the yoke 110 extend laterally relative to the rear rise seam 114*b*.

FIG. 3 illustrates an exploded frontal view of a trouser assembly 100 showing a perspective view of a support band 104 and a cutaway view of a trouser 102 that shows the inside of a rear portion of the trouser 102. FIG. 4 illustrates an exploded frontal view of a trouser assembly 100 showing a perspective view of a support band 104 and a cutaway view of a trouser 102 that shows the inside of a rear portion of the trouser 102, in which the support band 104 is coupled to an inner surface of the trouser 102.

Referring to FIG. 3 and FIG. 4, a trouser 102 includes a waistband 106, a right trouser leg 108*a*, a left trouser leg 108*b*, and a yoke 110. The waistband 106 has an upper waistband portion and a lower waistband portion.

The right trouser leg 108*a* has a right rear trouser leg portion and a right seat 112*a*. The left trouser leg 108*b* has a left rear trouser leg portion and a left seat 112*b*. The right seat 112*a* and the left seat 112*b* are coupled, e.g., stitched, together to form a rear rise seam 114*b*. The rear rise seam 114*b* extends from the crotch of the trouser 102 to the yoke 110. Additionally, the right seat 112*a* and the left seat 112*b* are coupled, e.g., stitched, to the lower portion of the yoke 110.

A lower support portion 302 of the support band 104 is coupled, e.g., with stitches 402, to the lower portion of the yoke 110, e.g., the lower edge of the yoke, Preferably, the lower support portion 302 is coupled to the same portion of the yoke 110 that is coupled to the right seat 112*a* of the right trouser leg 108*a* and the left seat 112*b* of the left trouser leg 108*b*.

The support band 104 has a first support end 304*a* and second support end 304*b*. The first support end 304*a* includes hooks. The second support end 304*b* includes loops. Thus, the first support end 304*a* and second support end 304*b* may be removably coupled via the hooks and loops.

Figure 5A:
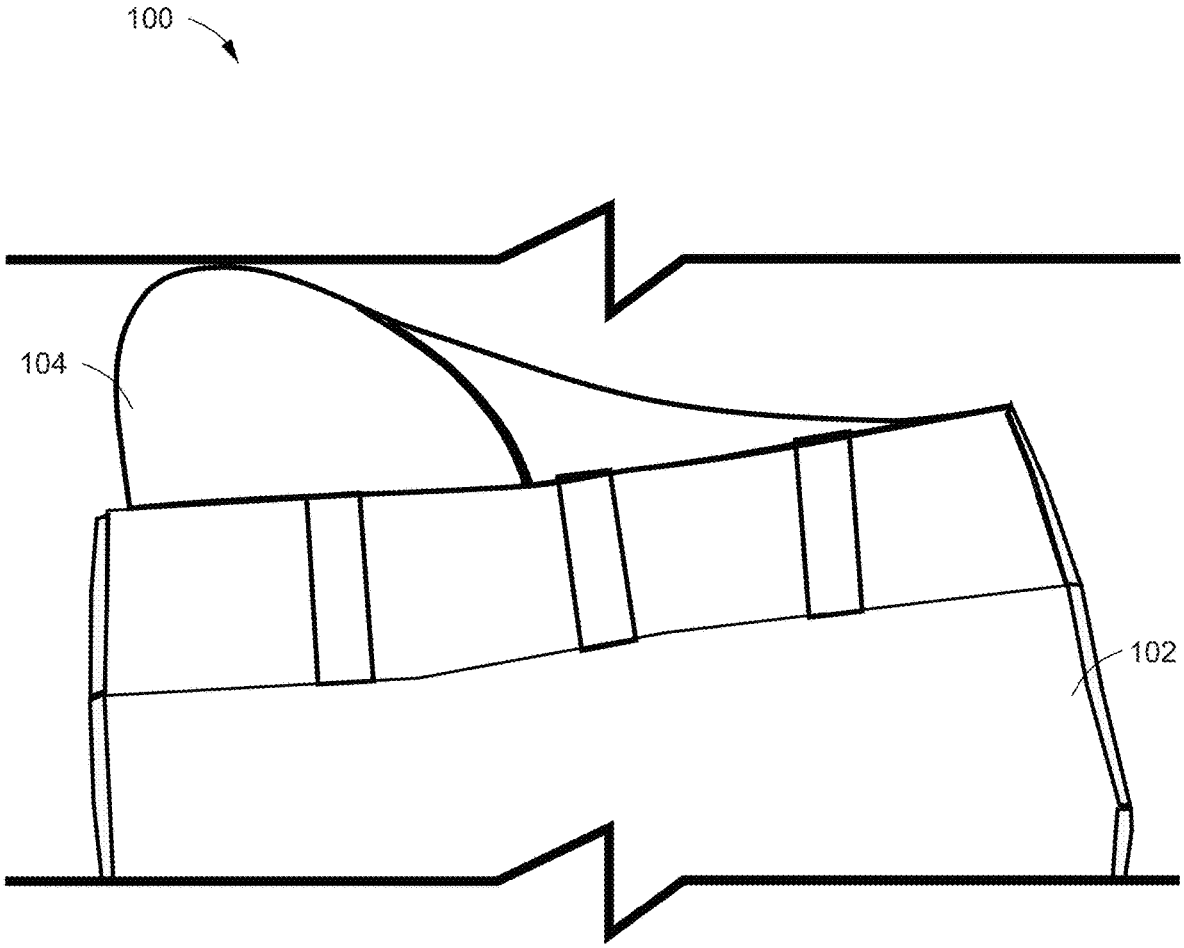
FIG. 5A illustrates a closeup side view of a trouser assembly including a trouser in a clasped configuration and a wrapped support band disposed therein.
Figure 5B:
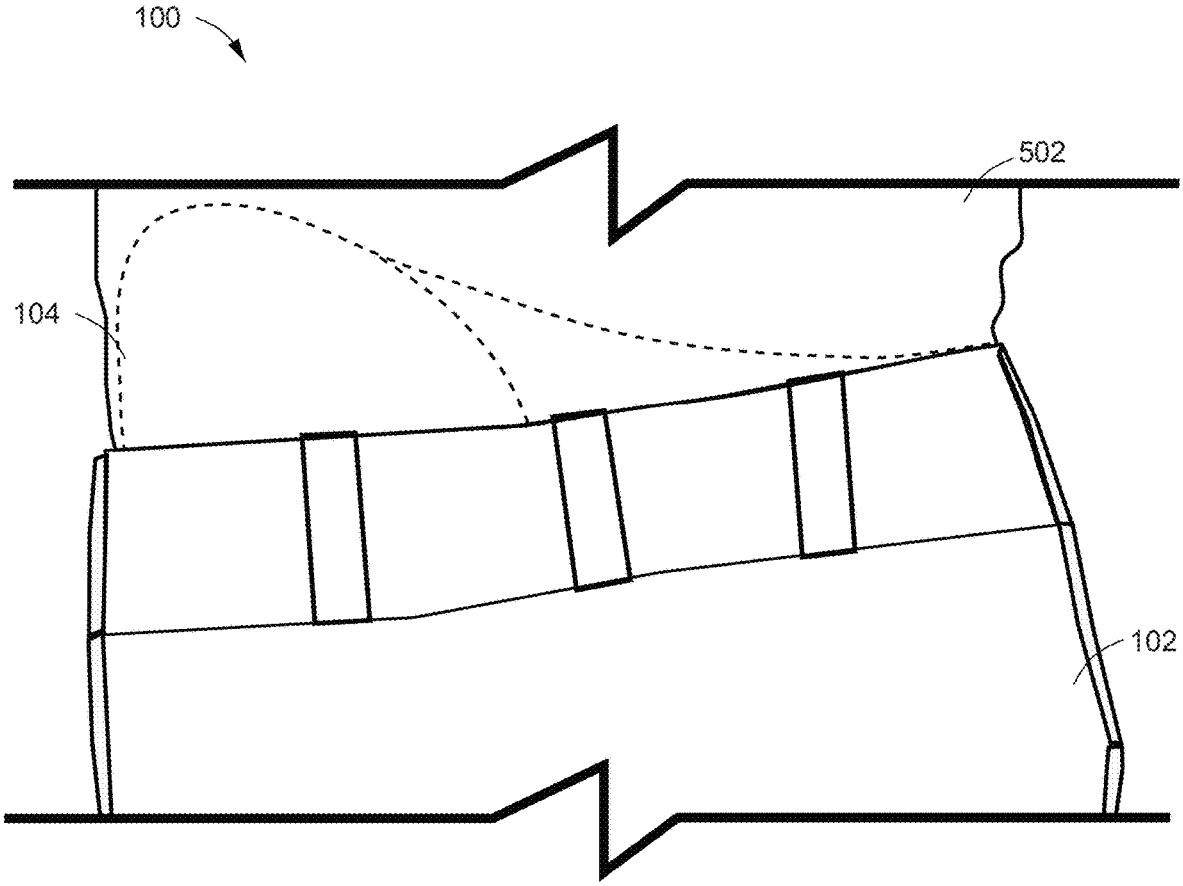
FIG. 5B illustrates a closeup side view of a trouser assembly having a lower portion of a shirt tucked therein and surrounding a support band.
Figure 5C:
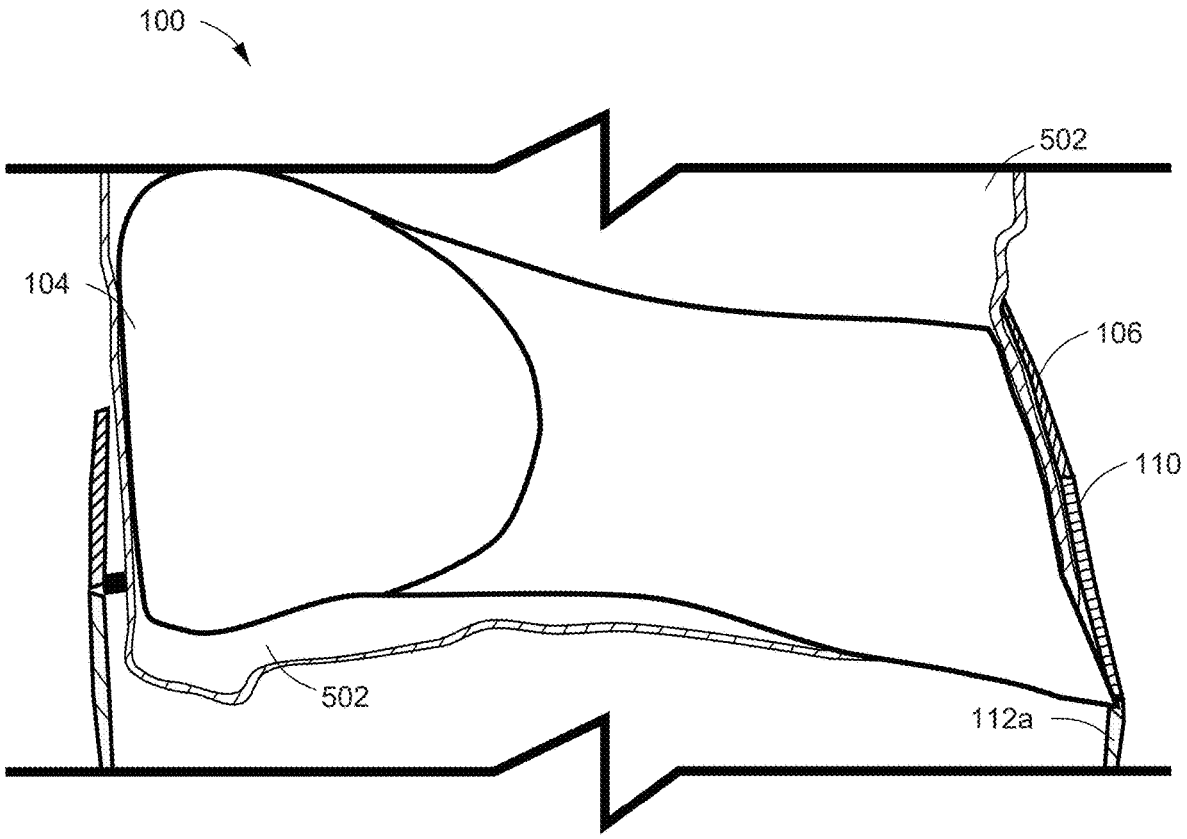
FIG. 5C illustrates a closeup cross-sectional side view of a trouser assembly having a wrapped support band inside a trouser and a lower portion of a shirt tucked between the support band and portions of the trouser.
Figure 5D:
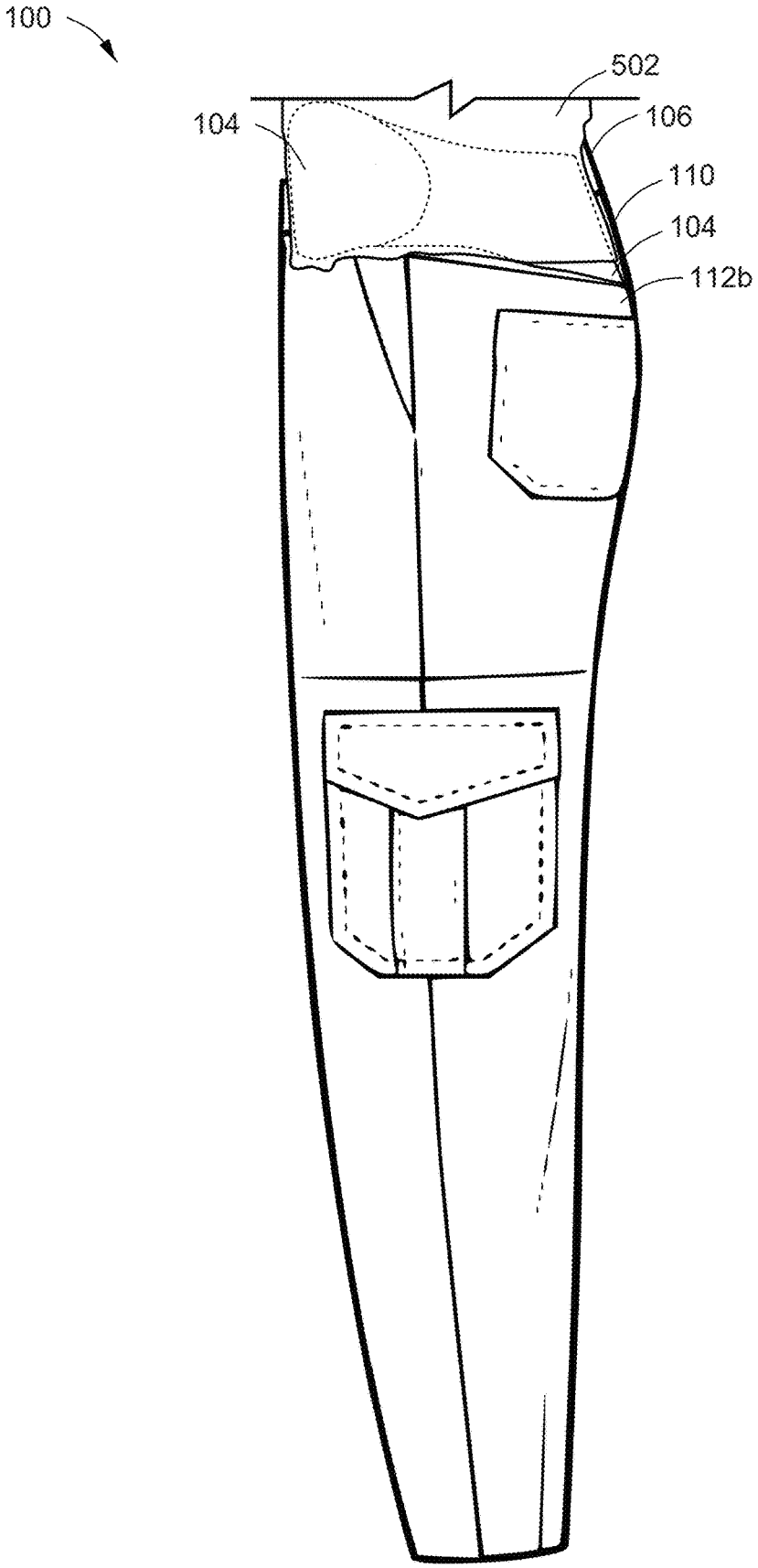
FIG. 5D illustrates a side view of a trouser assembly showing a perspective view of a wrapped support band inside a trouser and a cutaway view of a portion of the trouser in which a lower portion of a shirt is tucked between the support band and a portion of the trouser.

FIG. 5A illustrates a closeup side view of a trouser assembly 100 including a trouser 102 in a clasped configuration and a wrapped support band 104 disposed therein. FIG. 5B illustrates a closeup side view of a trouser assembly 100 having a lower portion of a shirt 502 tucked therein and surrounding a support band 104. FIG. 5C illustrates a closeup cross-sectional side view of a trouser assembly 100 having a wrapped support band inside a trouser 102 and a lower portion of a shirt 502 tucked between the support band 104 and portions of the trouser 102. FIG. 5D illustrates a side view of a trouser assembly 100 and a cutaway view of a portion of a trouser 102 showing a wrapped support band 104 inside the trouser 102 and shirt 502. In FIG. 5B and FIG. 5D, portions of the support band 104 disposed within a shirt 502 are shown with dash lines.

Referring to FIGS. 5A-D, a lower portion of a support band 104 is coupled, e.g., with stitches, to a lower portion of a yoke 110 of a trouser 102. Preferably, the lower portion of the support band 104 is coupled to the portion of the yoke 110 that is coupled to a right seat 112*a* of a right trouser leg 108*a* and a left seat 112*b* of a left trouser leg 108*b*, as shown in FIG. 4. Thus, an annulus exists between the lower portion of the support band 104 and an upper portion of the trouser 102.

A lower portion of a shirt 502 is tucked inside the trouser 102. Additionally, the lower portion of the shirt 502 is disposed around the support band 104. Accordingly, the lower portion of the shirt 502 is disposed between an outer surface of the support band 104 and an inner surface of the trouser 102. Moreover, the lower portion of the shirt 502 is disposed between an outer surface of the support band 104 and an inner surface of the yoke 110. However, the lower portion of the shirt 502 is inhibited from being tucked pass the stitching that couples the support band 104 with the yoke 110.

Benefits of trouser assemblies 100 disclosed herein and exemplified in FIGS. 1-5B include the ability to maintain a lower portion or "tail" of a shirt 502 to be tucked between a portion of a trouser 102 and a portion of a support band 104, e.g., so that the bottom of the shirt 502 does not fall around an upper portion of trouser 102 when worn together. Preferably, the bottom portion of the shirt can be positioned so that it is pinched between the support band and yoke as depicted in FIG. 5C. That capability is advantageous for persons who want to keep their shirts tucked in the trouser 102 to cover their bellies, waists, and backs while performing physical activities.

Figure 6:
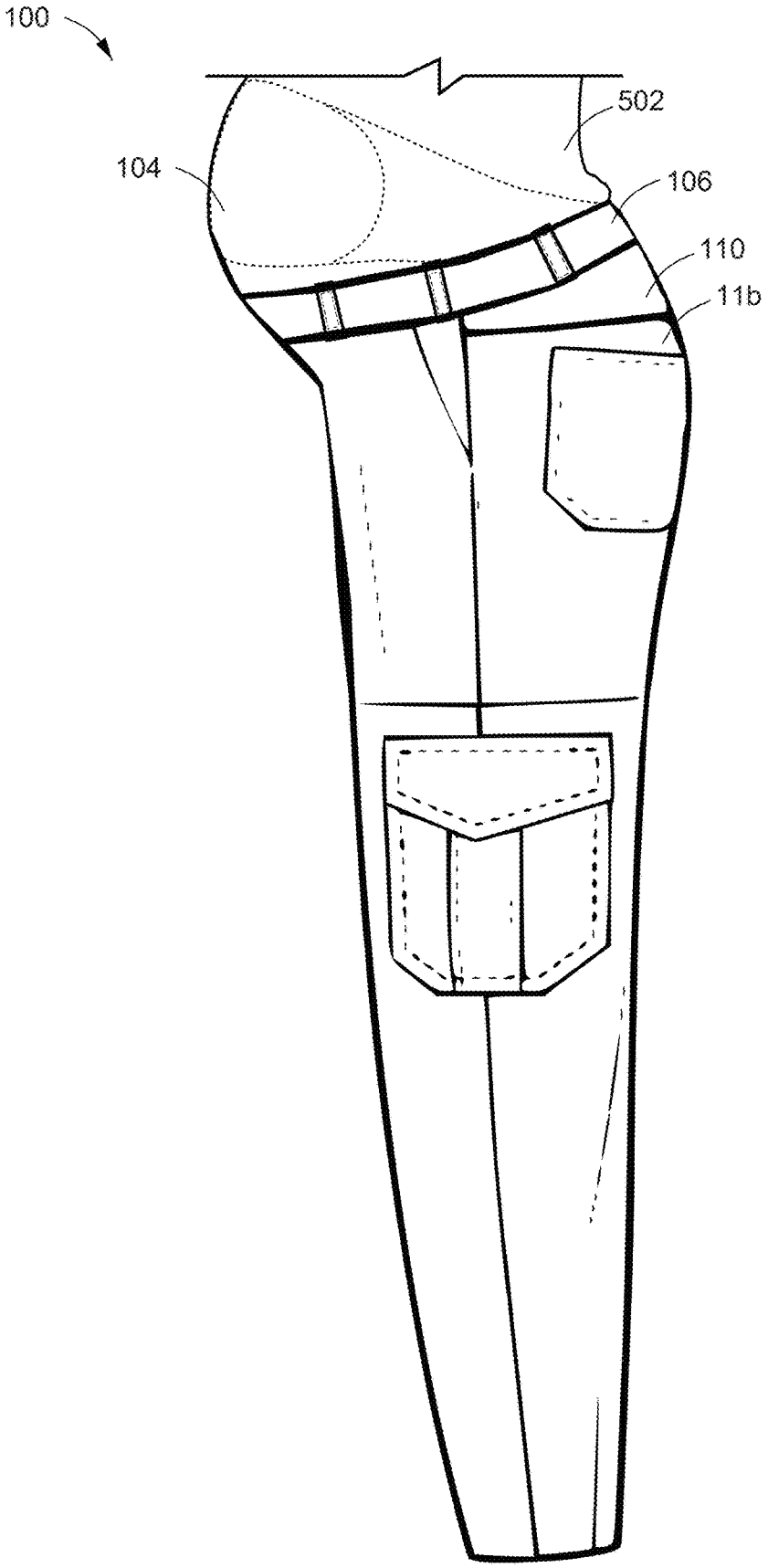
FIG. 6 illustrates a side view of a trouser assembly showing a perspective view of a wrapped support band inside a trouser and a shirt in which a lower portion of the shirt is tucked between the support band and a portion of the trouser.

FIG. 6 illustrates a side view of a trouser assembly 100 showing a perspective view of a wrapped support band 104 inside a trouser 102 and a shirt 502 in which a lower portion of the shirt 502 is tucked between the support band 104 and a portion of the trouser 102. The trouser assembly 100 is particularly beneficial to pregnant females who wear maternity trousers 102 with a support band 104 and wants to keep their shirts tucked in the trousers 102. Those pregnant females may wear trouser assemblies 100 and have lower portions of their shirts tucked in the trouser assemblies 100 to cover their pregnant bellies. In many cases, when wearing standard maternity trousers, mothers need to wear long shirts to drape over their pregnant bellies, which may be cumbersome when performing physical activities because the bottoms of the untucked shirts may obstruct their performance and/or expose their bellies, waists, and/or backs. That obstruction is avoided when wearing the trouser assemblies 100 disclosed herein.

Thus, referring to FIGS. 1-6, a pregnant mother may wear a trouser 102 coupled to a support band 104 of a trouser assembly 100 and may tuck a lower portion of a shirt 502 between the support band 104 and portions of the trouser 102, e.g., waistband and yoke. First, the mother may put on the trouser 102. Afterwards, she may wrap the support band 104 around her belly and lower back. Then, the mother may couple support ends 304*a*, 304*b* of the support band 104. The ends 304*a*, 304*b* may have respective hooks and loops that are coupled to each other, e.g., Velcro®. The coupled ends 304*a*, 304*b* are able to retain the front of the support band 104 against the mother's belly and the back portion of the support band against her lower back. In some cases, the support band 104 would inhibit the trouser 102 from slipping off the mother because the support band 104 is coupled to a yoke 110 in the rear of the trouser 102.

Next, the mother may pull a lower portion of the shirt 502 over and/or around the support band 104. Furthermore, the mother may tuck the lower portion of the shirt 502 into the trouser 102. Accordingly, the lower portion of the shirt 502 would be disposed between inners surfaces of the waistband 106 and the yoke 110 and outer surfaces of the support band 104.

Then, the mother may couple a first waistband end to a second waistband end. Also, the mother may zip a fly on the trouser 102. The coupled first waistband end and second waistband and the zipped fly may cause the waistband 106 and the yoke 110 to respectively press against the belly and lower back of the mother. Accordingly, the waist band 106 and the yoke 110 would press the lower portion of the shirt 502 against the outer surface of an adjacent portion of the support band 104. Friction between the support band 104, the shirt 502, and the waistband 102 would inhibit the shirt 502 from slipping out from between the support band 104 and the waistband 102. Additionally, friction between the support band 104, the shirt 502, and the yoke 110 would inhibit the shirt 502 from slipping out from between the support band 104 and the yoke 110. Therefore, the mother may perform physical activities without having her tucked shirt 502 fall out of the trouser assembly 100.

It should be understood that in some cases, trouser assemblies 100 discussed herein may be worn by males as well.

What is claimed as the invention is:

1. A method of tucking a lower portion of a shirt, comprising:

providing a trouser assembly, comprising:

a waistband having an upper waistband portion and a lower waistband portion;

a yoke having an upper yoke portion coupled to the lower waistband portion and a lower yoke portion, a seat having an upper seat portion coupled to the lower yoke portion; and a support band having an upper support portion and a lower support portion, wherein the lower support portion is coupled to the lower yoke portion;

wrapping the support band around a human waist that is upright, wherein the lower support portion is disposed below the upper yoke portion and below the waistband;

disposing a portion of the lower portion of the shirt between the support band and the yoke;

abutting a portion of the lower portion of the shirt against the support band;

abutting a portion of the lower portion of the shirt against the yoke; and pressing, with the waistband, a portion of the lower portion of the shirt against the support band.

2. The method of claim 1, wherein the lower portion of the shirt is inhibited from slipping from between the support band and the yoke.

3. The method of claim 1, further comprising disposing a portion of the lower portion of the shirt between the support band and the waistband.

4. The method of claim 1, wherein the lower portion of the shirt is inhibited from slipping from between the support band and the waistband.

5. The method of claim 1, wherein the lower support portion is adjacent to the yoke.

6. The method of claim 1, wherein the lower yoke portion is below the waistband.

7. The method of claim 1, wherein the upper yoke portion is above the seat.

8. A method of tucking a lower portion of a shirt, comprising:

providing a trouser assembly, comprising:

a waistband having an upper waistband portion and a lower waistband portion;

a yoke having an upper yoke portion coupled to the lower waistband portion and a lower yoke portion, a seat having an upper seat portion coupled to the lower yoke portion; and a support band having an upper support portion and a lower support portion, wherein the lower support portion is coupled to the lower yoke portion and the upper support portion is above the waistband;

wrapping the support band around a human waist that is upright, wherein the lower support portion is disposed below the upper yoke portion and below the waistband;

disposing a portion of the lower portion of the shirt between the support band and the yoke;

abutting a portion of the lower portion of the shirt against the support band; and abutting a portion of the lower portion of the shirt against the yoke.

9. A method of tucking a lower portion of a shirt, comprising:

providing a trouser assembly, comprising:

a waistband having an upper waistband portion, a lower waistband portion, an outer waistband surface, and an inner waistband surface;

a yoke having an upper yoke portion, a lower yoke portion, an outer yoke surface, and an inner yoke surface, wherein the upper yoke portion is coupled to the lower waistband portion;

a seat having an upper seat portion coupled to the lower yoke portion; and a support band having an upper support portion, a lower support portion, an outer support surface, and an inner support surface, wherein the lower support portion is coupled to the lower yoke portion;

wrapping the support band around a human waist that is upright, wherein the lower support portion is disposed below the upper yoke portion and below the waistband;

disposing a portion of the lower portion of the shirt between the outer support surface and the inner yoke surface;

abutting an inner surface of the lower portion of the shirt against the outer support surface; and abutting an outer surface of the lower portion of the shirt against the inner yoke surface.

10. The method of claim 9, further comprising disposing a portion of the lower portion of the shirt between the outer support surface and the inner waistband surface.

11. The method of claim 9, wherein the lower portion of the shirt is inhibited from slipping from between the outer support surface and the inner yoke surface.

12. The method of claim 9, wherein the lower portion of the shirt is inhibited from slipping from between the outer support surface and the inner waistband surface.

13. The method of claim 9, wherein the upper support portion is above the waistband.

14. The method of claim 9, wherein the outer support surface is adjacent to the inner yoke surface.

15. The method of claim 9, wherein the outer support surface is adjacent to the inner waistband surface.

16. The method of claim 9, further comprising pressing, with the waistband, a portion of the lower portion of the shirt against the outer support surface.

* * * * *